US006821152B2

(12) United States Patent
Van Dyke

(10) Patent No.: US 6,821,152 B2
(45) Date of Patent: Nov. 23, 2004

(54) POWER ENTRY PANEL WITH INPUT TERMINAL BLOCK HAVING DIRECT CONNECTION

(75) Inventor: Barbara A. Van Dyke, Freeport, PA (US)

(73) Assignee: Marconi Communications, Inc., Warrendale, PA (US)

( * ) Notice: Subject to any disclaimer, the term of this patent is extended or adjusted under 35 U.S.C. 154(b) by 0 days.

(21) Appl. No.: 09/833,159

(22) Filed: Apr. 12, 2001

(65) Prior Publication Data

US 2002/0151219 A1 Oct. 17, 2002

(51) Int. Cl.[7] ..... H01R 13/68

(52) U.S. Cl. ..... 439/620; 439/939; 439/709; 361/629; 361/633; 361/823

(58) Field of Search ..... 439/620, 92, 939, 439/540.1, 215, 721, 709; 361/629, 633, 823, 627, 822, 824, 826; 174/51

(56) References Cited

U.S. PATENT DOCUMENTS 4,797,120 A * 1/1989 Ulery ..... 439/578
5,102,354 A * 4/1992 Crane et al. ..... 439/620
5,411,416 A * 5/1995 Balon et al. ..... 439/540.1
5,589,718 A * 12/1996 Lee ..... 439/620
5,808,876 A * 9/1998 Mullenbach et al. ..... 439/928
5,989,073 A * 11/1999 Kahoun ..... 439/709
6,059,608 A * 5/2000 Benes ..... 439/620
6,091,609 A * 7/2000 Hutson et al. ..... 361/794
6,315,580 B1 * 11/2001 Hurtubise et al. ..... 439/716
6,320,776 B1 * 11/2001 Kajiura et al. ..... 361/709
6,359,770 B1 * 3/2002 Kolody et al. ..... 439/709
6,371,791 B1 * 4/2002 Newton, Jr. ..... 439/620

* cited by examiner

*Primary Examiner*—P. Austin Bradley
*Assistant Examiner*—Briggitte R. Hammond
(74) *Attorney, Agent, or Firm*—Ansel M. Schwartz

(57) ABSTRACT

A power entry panel for a power conditioner. The power entry panel includes an input terminal block which receives power. The power entry panel includes a mating connection for passing power from the input terminal block to the power conditioner. The mating connection is directly connected and in contact with the input terminal block. An input terminal block for a power entry panel. A method for transferring power.

11 Claims, 5 Drawing Sheets

POWER ENTRY PANEL WITH INPUT TERMINAL BLOCK HAVING DIRECT CONNECTION

FIELD OF THE INVENTION

The present invention is related to a power entry panel for a power conditioner. More specifically, the present invention is related to a power entry panel for a power conditioner having an input terminal block directly connected and in contact with a mating connection.

BACKGROUND OF THE INVENTION

The telecommunication industry is currently driving the industry for higher density products, which in turn is driving up the requirement for system power delivery. Recent switch chassis density requires a level of power entry and delivery exceeding that of any other currently disclosed industry product. The traditional method of interconnection from input through to output terminals in a 150 Amp 48 V DC power delivery system would require the use of #2 wires and/or bus bars utilizing an unacceptable quantity of 600 mm ETSI (incorporated by reference herein) compliant chassis real estate rendering the chassis space requirements inadequate for the remainder of system design. The present chassis power entry eliminates the use of any wires or bus bars. The present chassis power entry accomplishes the requirement for 150 Amps of 48 V DC power delivery without utilizing an unreasonable percentage of the 600 mm ETSI compliant chassis real estate.

The present power entry panel is unique as an innovative hybrid of custom and industry available parts eliminating the use of any wires or bus bars. The design reduces the part count, complexity and quantity of interconnections used with traditional wire and bus bar assemblies, therefore reducing real estate requirements, cost and additionally improving performance.

SUMMARY OF THE INVENTION

The present invention pertains to a power entry panel for a power conditioner. The power entry panel comprises an input terminal block which receives power. The power entry panel comprises a mating connection for passing power from the input terminal block to the power conditioner. The mating connection is directly connected and in contact with the input terminal block.

The present invention pertains to an input terminal block for a power entry panel. The input terminal block comprises a terminal pin for conducting power adapted to be directly connected and in contact with a mating connection of the power entry panel. The input terminal block comprises a support block through which the terminal pin extends. The support block supports the terminal pin. The input terminal block comprises a filtering layer disposed on the support block for filtering power.

The present invention pertains to a method for transferring power. The method comprises the steps of receiving power at an input terminal block. There is the step of passing power from the input terminal block through a mating connection that the input terminal block is directly connected and in contact with to a power conditioner.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
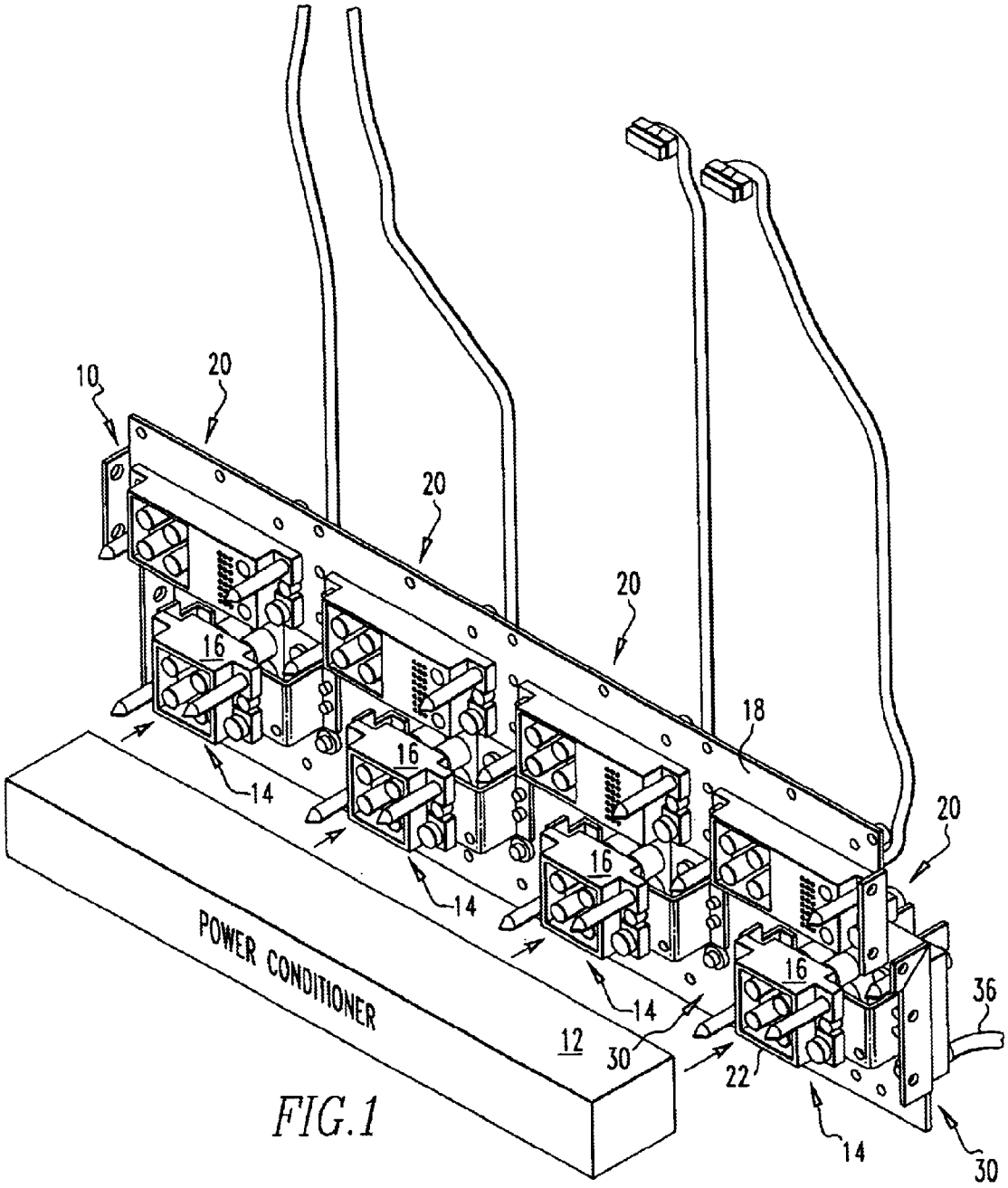
FIG. 1 is a schematic representation of a perspective view of a power entry panel for a power conditioner of the present invention.
Figure 2:
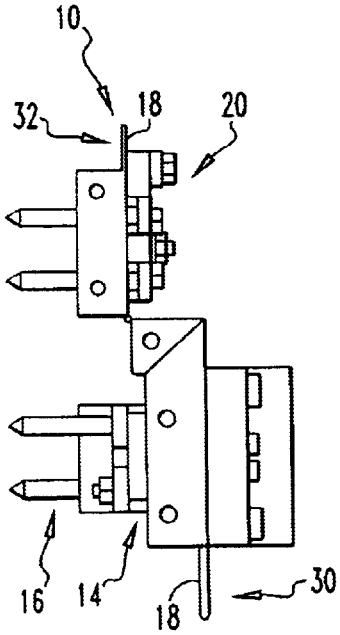
FIG. 2 is a schematic representation of a right side view of the power entry panel.

Referring now to the drawings wherein like reference numerals refer to similar or identical parts throughout the several views, and more specifically to FIGS. 1, 2, 7-9 and 11 thereof, there is shown a power entry panel 10 for a power conditioner 12. The power entry panel 10 comprises an input terminal block 14 which receives power. The power entry panel 10 comprises a mating connection 16 for passing power from the input terminal block 14 to the power conditioner 12. The mating connection 16 is directly connected and in contact with the input terminal block 14.

Preferably, the power entry panel 10 includes a ground panel 18 to which the input terminal block 14 is in contact. The power entry panel 10 preferably includes an output connector 20 to which power from the power conditioner 12 is transmitted. Preferably, the output connector 20 is chassis ground to the ground panel 18.

Figure 3:
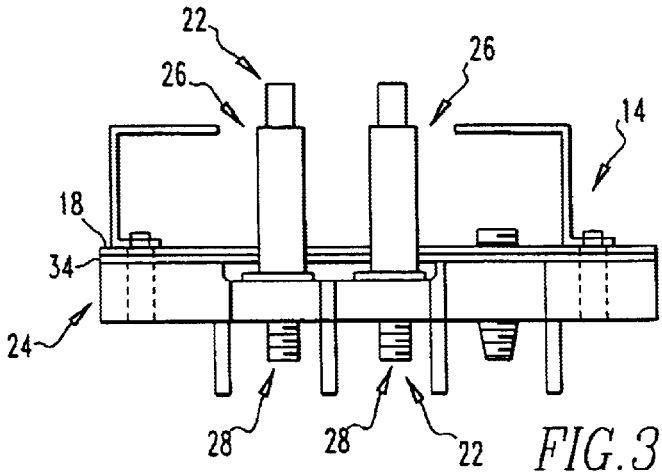
FIG. 3 is a schematic representation of a side exposed view of the input terminal block.
Figure 4:
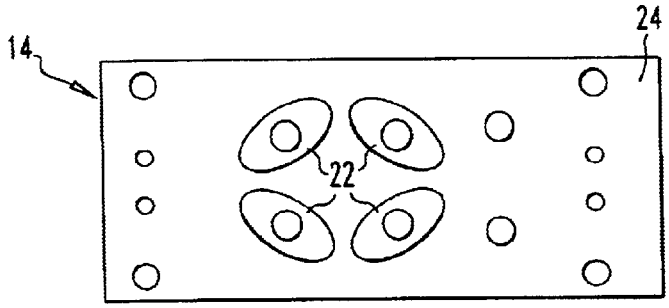
FIG. 4 is a schematic representation of an overhead view of the input terminal block.
Figure 10B:
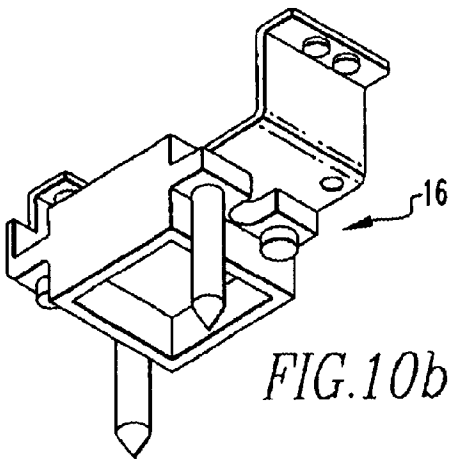
FIG. 10 is an exploded view of the support block and the mating connection.
Figure 10A:
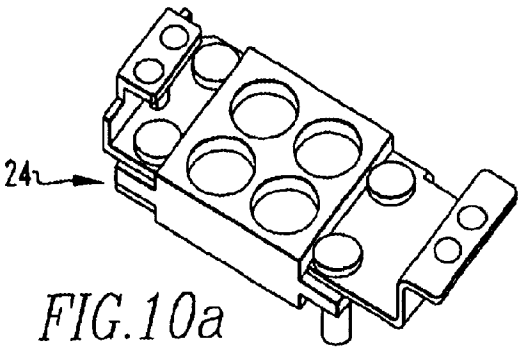

The input terminal block 14 preferably includes at least one terminal pin 22 that directly connects and is in contact with the mating connection 16. Preferably, the input terminal block 14 includes a support block 24 through which the terminal pin 22 extends, as shown in FIGS. 3, 4 and 10. The support block 24 supports the terminal pin 22 and isolates the terminal pin 22.

Figure 5:
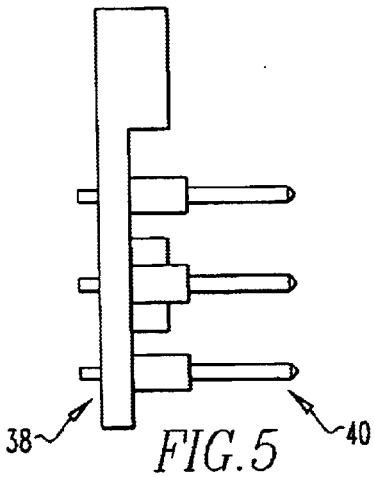
FIGS. 5 and 6 are schematic representations of perspective and side views of the earthground bus bar and pin, respectively.
Figure 6:
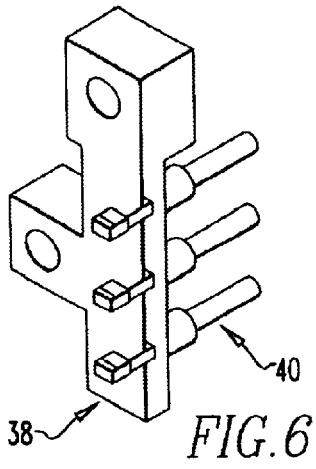
Figure 11:
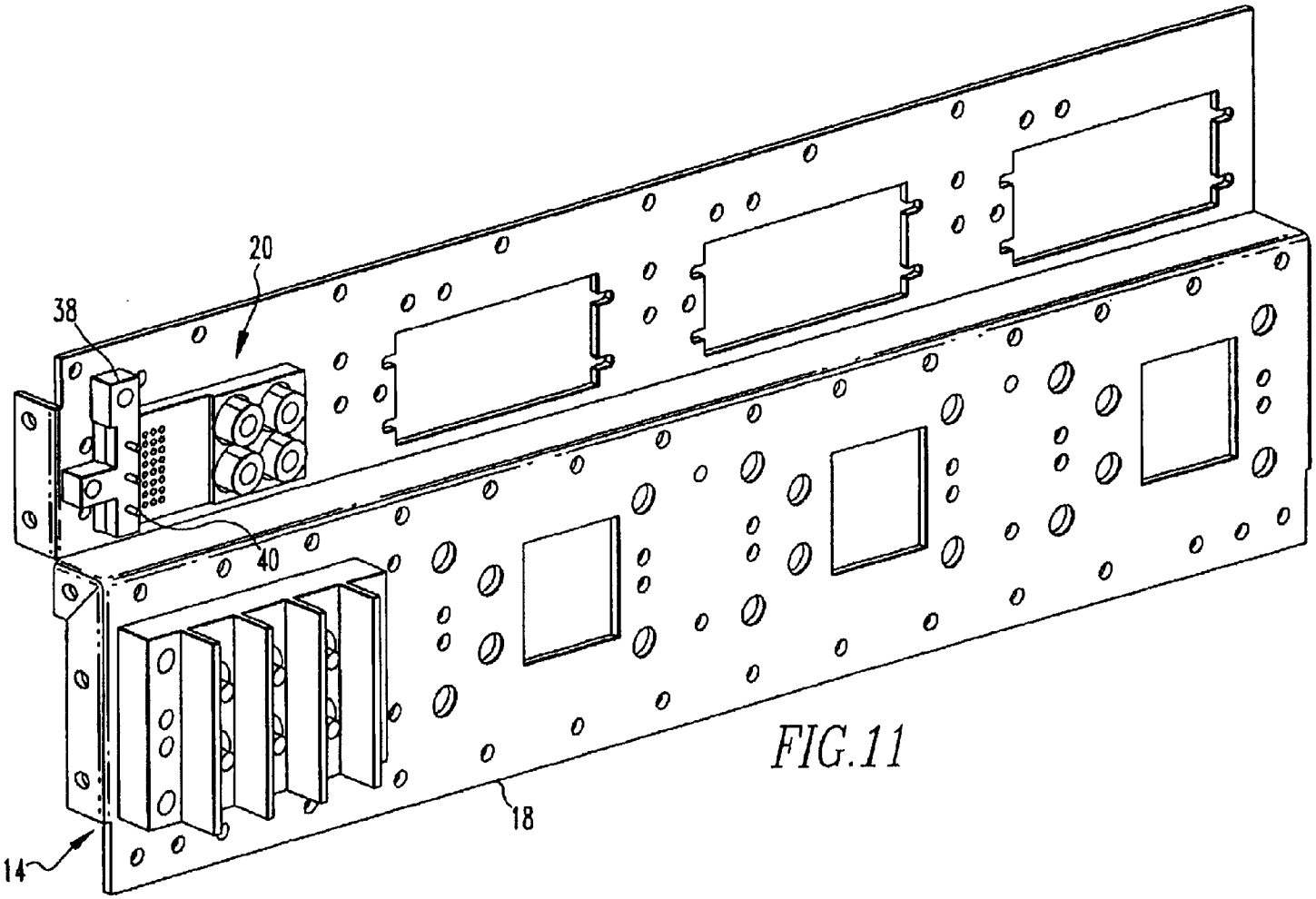
FIG. 11 is a schematic representation of a perspective rear view of a partially populated power entry panel.

The terminal pin 22 preferably has a long end 26 and a short end 28. The support block 24 preferably has a wire side 30 and a connector side 32. The input terminal block 14 preferably includes a filtering layer 34 for filtering the power. The power filtering layer 34 is preferably disposed on the connection side. The long end 26 preferably extends from the connection side and connects with the mating connection 16, and the short end 28 preferably extends from the wire side 30 and connects with a power wire 36 to which power is delivered to the input terminal block 14. Preferably, the output connector 20 includes a bus bar 38, and a pin 40 which is press fit onto the bus bar 38 to form the chassis ground, as shown in FIGS. 5, 6 and 11. The input terminal block 14 preferably provides 150 amps of power.

The present invention pertains to an input terminal block 14 for a power entry panel 10. The input terminal block 14 comprises a terminal pin 22 for conducting power adapted to be directly connected and in contact with a mating connection 16 of the power entry panel 10. The input terminal block 14 comprises a support block 24 through which the terminal pin 22 extends. The support block 24 supports the terminal pin 22. The input terminal block 14 comprises a filtering layer 34 disposed on the support block 24 for filtering power.

The present invention pertains to a method for transferring power. The method comprises the steps of receiving power at an input terminal block 14. There is the step of passing power from the input terminal block 14 through a mating connection 16 that the input terminal block 14 is directly connected and in contact with to a power conditioner 12.

Preferably, there is the step of sending the power from the power conditioner 12 through an output connector 20. There is preferably the step of grounding the output connector 20 to a chassis ground panel 18. Preferably, the passing step includes the step of passing 150 amps of 48 V DC power from the input terminal block 14 through the mating connection 16 to the power conditioner 12.

In the operation of the invention, the traditional method of 150 Amps of 48 V DC power entry transition from outside chassis to power conditioner 12, would be to use an industry available connector set and industry available panel mounted terminals or terminal block and accomplish an interconnection between the two with the use of #2 wires and/or bus bars. The power entry panel 10, shown in FIGS. 1 and 2, utilizes a custom input power entry terminal block that transitions directly, in a unique way, to an industry available connector housing eliminating the wires and/or bus bars and their respective mechanical connections. The input terminal block 14, shown in FIGS. 4 and 5, is designed to panel mount with the appropriate connection terminals for incoming power and ground feeds. Filtering capabilities are incorporated into the input terminal block 14 with a printed circuit board filter layer 34 according to well known filtering techniques. The power entry side of the industry available connector set is an Elcon Products International Co. quad-power pin housing. A unique aspect of this design is the elimination of the standard Elcon connector pin, utilizing the Elcon connector housing only as the mating connection 16. The pin requirements have been custom designed into a terminal pin 22 that transitions, with appropriately designed support structure, from the custom input terminal block 14 to the Elcon mating connection 16 housing.

Figure 7:
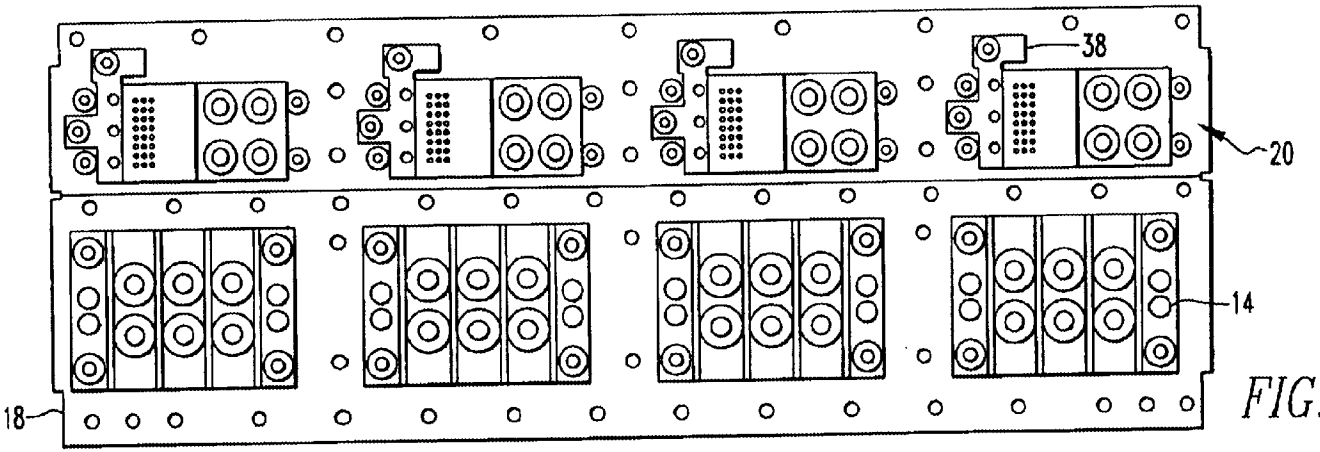
FIGS. 7 and 8 are wire side and connection side views, respectively, of the power entry panel without the mating connections.
Figure 8:
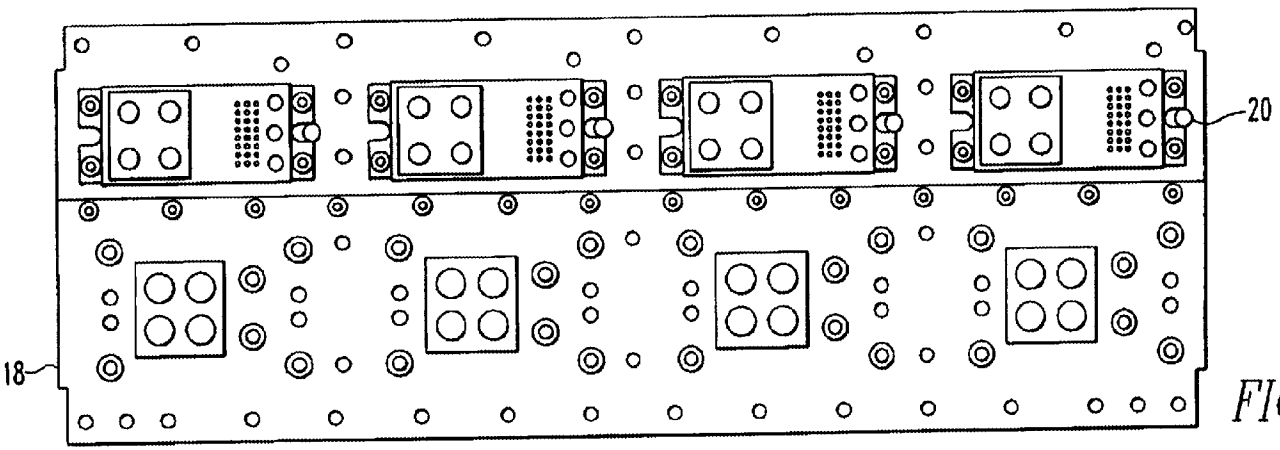
Figure 9:
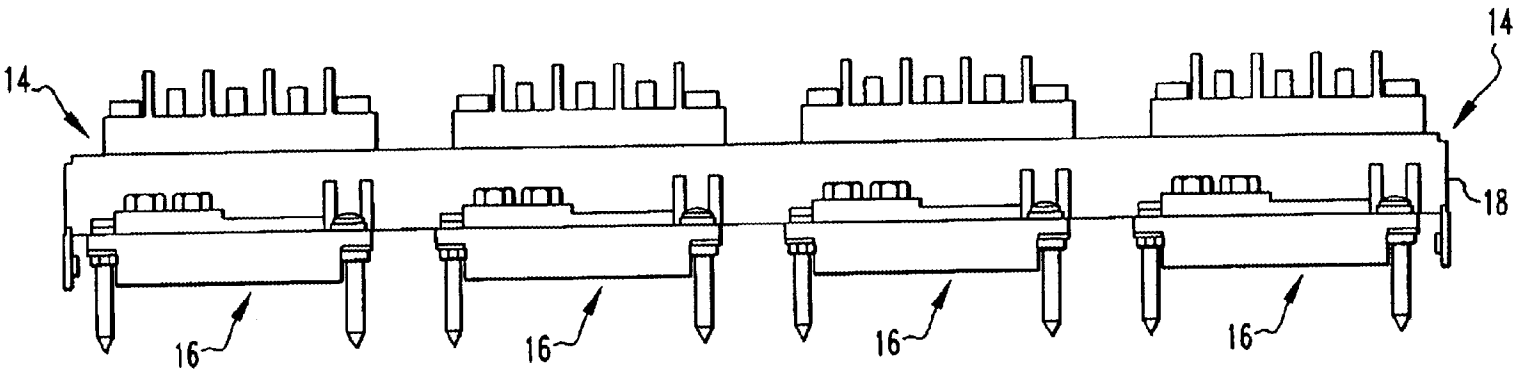
FIG. 9 is an overhead view of the power entry panel.

Another unique aspect is the earth ground for the power conditioner 12 accomplished with a bus bar 38 incorporating Elcon #12 pins 40 at the output connector 20 from PCM, as shown in FIGS. 5, 6 and 7. FIGS. 3 and 4 show the Elcon pin requirements incorporated to design a terminal pin 22 for input terminal block 14 that would transition directly to the Elcon housing mating connection 16. The input terminal block and power entry assembly utilizes a two-piece rather than a one-piece pin design. The transition from input terminal block 14 to Elcon mating connection 16 housing included an offset dimension that is more effectively manufacturable in a two-piece terminal pin 22 design rather than a one-piece terminal pin 22 design.

Each input terminal block 14 has a pattern of 4 terminals that transition from a short end 28 to an internal Elcon mating connection 16 housing. There is an offset in these two patterns that requires the terminal pin 22 design to have 2 different axis. This is accomplished with a 2 piece design. The terminal pin 22 was designed by duplicating the Elcon required features and incorporating the requirements necessary to transition from the input terminal block 14 to the Elcon mating connection 16 housing.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A power entry panel for a power conditioner comprising:

an input terminal block which receives at least 150 amps of 48 V DC power, input terminal block including at least one terminal pin and a support block through which the terminal pin extends, the support block supporting the terminal pin and isolating the terminal pin, the input terminal block including a power filtering layer for filtering the power positioned about the terminal pin;

a ground panel to which the input terminal block is in contact;

an output connector to which power from the power conditioner is transmitted; and a mating connection for passing the power from the input terminal block to the power conditioner, the mating connection directly connected and in contact with the terminal pin of the input terminal block and the power conditioner.

2. A power entry panel as described in claim 1 wherein the output connector is chassis ground to the ground panel.

3. A power entry panel as described in claim 2 wherein the terminal pin has a long end and a short end, the support block has a wire side and a connector side, and the input terminal block includes a filtering layer for filtering the power, the power filtering layer disposed on the connector side, the long end extending from the connector side and connecting with the mating connection, and the short end extending from the wire side and connecting with a power wire to which power is delivered to the input terminal block.

4. A power entry panel as described in claim 3 wherein the output connector includes a bus bar, and a pin which is press fit onto the bus bar to form the chassis ground.

5. A method for transferring power comprising the steps of:

receiving at least 150 amps of 48 V DC power at an input terminal block in contact with a chassis ground panel of a power entry panel which also has an output connector to which power from the power conditioner is transmitted, the input terminal block having a support block through which the terminal pin extends, the support block supporting the terminal pin and isolating the terminal pin, the input terminal block including a power filtering layer for filtering the power positioned about the terminal pin;

a ground panel to which the input terminal block is in contact;

passing the 150 amps of 48 V DC power from the input terminal block through a mating connection that the input terminal block is directly connected and in contact with to a power conditioner; and sending the power from the power conditioner through the output connector.

6. A method as described in claim 5 including the step of grounding the output connector to the chassis ground panel.

7. A power entry panel for a power conditioner comprising:

an input terminal block which receives power, the input terminal block includes at least one terminal pin and a support block through which the terminal pin extends, the support block supporting the terminal pin and isolating the terminal pin, the terminal pin has a long end and a short end, the support block has a wire side and a connector side, and the input terminal block includes a filtering layer for filtering the power, the power filtering layer disposed on the connector side;

a mating connection for passing power from the input terminal block to the power conditioner, the mating connection directly connected and in contact with the terminal pin of the input terminal block, the long end extending from the connector side and connecting with the mating connection, and the short end extending from the wire side and connecting with a power wire to which power is delivered to the input terminal block;

a ground panel to which the input terminal block is in contact; and an output connector to which power from the power conditioner is transmitted, the output connector is chassis ground to the ground panel.

8. A power entry panel as described in claim 7 wherein the output connector includes a bus bar, and a pin which is press fit onto the bus bar to form the chassis ground.

9. A power entry panel as described in claim 8 wherein the input terminal block provides 150 amps of 48 V DC power.

10. A power entry panel for a power conditioner comprising:

an input terminal block which receives at least 150 amps of 48 V DC power, the input terminal block including at least one terminal pin and a support block through which the terminal pin extends, the support block supporting the terminal pin and isolating the terminal pin, the input terminal block including printed circuit board power filtering layer for filtering the power positioned about the terminal pin; and a mating connection for passing the power from the input terminal block to the power conditioner, the mating connection directly connected and in contact with the terminal pin of the input terminal block and the power conditioner.

11. A method for transferring power comprising the steps of:

receiving at least 150 amps of 48 V DC power at an input terminal block having a support block through which the terminal pin extends, the support block supporting the terminal pin and isolating the terminal pin, the input terminal block including a printed circuit board power filtering layer for filtering the power positioned about the terminal pin; and passing the 150 amps of 48 V DC power from the input terminal block through a mating connection that the input terminal block is directly connected and in contact with to a power conditioner.

* * * * *